US006330787B1

(12) United States Patent
Michnik

(10) Patent No.: US 6,330,787 B1
(45) Date of Patent: Dec. 18, 2001

(54) MONITORING CONTROL DEVICE WITH REAL TIME DATA SAMPLING FOR MACHINE USED IN THE CABLE INDUSTRY

(75) Inventor: Yves Michnik, Saint Ismier (FR)

(73) Assignee: Innocable SA, Saint Ismier (FR)

( * ) Notice: Subject to any disclaimer, the term of this patent is extended or adjusted under 35 U.S.C. 154(b) by 0 days.

(21) Appl. No.: 09/582,035

(22) PCT Filed: Jan. 8, 1998

(86) PCT No.: PCT/FR98/00028

§ 371 Date: Jun. 21, 2000

§ 102(e) Date: Jun. 21, 2000

(87) PCT Pub. No.: WO99/35329

PCT Pub. Date: Jul. 15, 1999

(51) Int. Cl.[7] ..... D01H 13/14
(52) U.S. Cl. ..... 57/264; 57/14
(58) Field of Search ..... 57/1 R, 3, 14, 57/10, 11, 264, 93, 98, 92, 58.52, 58.65, 58.67, 314

(56) References Cited

U.S. PATENT DOCUMENTS 4,102,117 * 7/1978 Dornberger ..... 57/93
5,144,792 * 9/1992 Lange et al. ..... 57/59
5,782,075 * 7/1998 Meggle ..... 57/264
5,791,134 * 8/1998 Schneider et al. ..... 57/6

FOREIGN PATENT DOCUMENTS 2 713 246 A 6/1995 (FR) .
2 739 701 A 4/1997 (FR) .
93/07330 4/1993 (WO) .

* cited by examiner

*Primary Examiner*—Danny Worrell
(74) *Attorney, Agent, or Firm*—Oliff & Berridge, PLC

(57) ABSTRACT

The monitoring and control device with real time data sampling comprises an optical measuring apparatus, a processing circuit with microprocessor, and an external control means. The microprocessor receives and samples data coming from the optical measuring apparatus to know the position of the wire element and its mechanical vibration behavior in real time before it is wound onto the main cable. An EPROM memory is programmed to generate a self-correction function should a drift of the position and vibration data of the wire element occur. The first motor, the second motor, and the mechanical tensioning means are controlled to re-establish optimum operation of the assembly machine.

6 Claims, 7 Drawing Sheets

Vibration Measurement – Means of Maxima and Minima

MONITORING CONTROL DEVICE WITH REAL TIME DATA SAMPLING FOR MACHINE USED IN THE CABLE INDUSTRY

BACKGROUND OF THE INVENTION

The invention relates to a monitoring and control device for an assembly machine designed to perform a winding operation of at least one wire element onto a main cable to form a wound cable, said assembly machine being equipped with actuators comprising:

- a winding head which guides said wire element wound on at least one feeder coil,
- a first head motor for driving the winding head in rotation,
- a second motor for driving in rotation a receiver coil on which said wound cable is wound,
- and means for mechanical tensioning of the wire element when the winding phase takes place, said monitoring and control device comprising:

- an optical measuring apparatus containing at least one light emitter for projection of a light beam onto the wire element, and a receiver for sensing the reflected light beam with production of a measurement signal,
- a processing circuit with microprocessor designed to receive said measurement signal and to send control and/or adjustment signals to said actuators,
- and an external control means comprising in particular a microcomputer for input of the automatic operation parameters of the assembly machine according to a predetermined program of the processing circuit.

The present invention relates in a general manner to an assembly machine designed to perform a winding operation of at least one wire element.

More precisely the invention relates to a monitoring and control device with real time data sampling for such an assembly machine.

The invention can apply for example to an assembly machine designed to wind wire elements together on one another or with one another, and it can also apply to an assembly machine designed to wind one or more peripheral wire elements onto a central cable. These elements can be metallic or composed of other materials.

Henceforth in the text the term wire element shall refer to any object in the form of a cable or wire whose cross section may have any shape (the wire element being able for example to be a thin strip), but is in most cases of appreciably circular general shape constant over its whole length. Such a wire element can constitute a simple wire object performing an essentially mechanical function (for example a reinforcing wire or an insulating or protective strip), or can constitute a cable including one or more wires performing transmission of an energy or a signal in electrical, magnetic, optical or any other form.

Henceforth in the text the term central cable shall refer to any wire element as defined above, but whose stiffness or tensile strength is in a general manner relatively high to enable another wire element to be wound around this central wire element.

Henceforth in the text the term 'peripheral wire element' shall refer to any wire element as defined above, but whose stiffness is in a general manner lower than that of the central wire element so that the peripheral wire element can be wound around the central cable.

However a central cable with a lower stiffness than that of the peripheral wire element could also be envisaged, without departing from the spirit of the invention, wherein the central cable is held with a sufficiently high tension for it to however be possible to wind the peripheral wire element around the central cable.

Henceforth in the text the term 'winding operation' shall refer to any operation performed by the device according to the present invention designed to cause winding of at least one wire element on or with at least another wire element or on a central cable.

Among such possible winding operations, the following examples can be given:

- lapping, i.e. winding of a wire element in turns which may be joined or not in general on a central cable.
- stranding, i.e. winding of several wire elements respecting a previously defined winding pitch (distance measured on the central cable between the beginning and the end of winding, having the same reference on the circumference of the cable at the beginning and end of winding).
- taping, coating a central cable with one or more strips,
- an operation consisting in creating a braiding around a central cable, this braiding being formed by several flat strips, a flat strip being constituted by several wire elements or by individual wire elements wound around the central cable and alternating with one another so as to form one or more braiding layers around the central cable, notably to form a coaxial cable. The braiding may constitute a meshing of several flat strips formed by several wire elements. Such a braiding can be used for example to constitute a shielding for the central cable, or any other protection for the central cable,
- a braiding performed on itself, i.e. without being applied around a central cable, so as to form a solid braid or a hollow braid.

Henceforth in the text the term 'assembly machine' shall refer to any machine enabling such possible winding operations to be performed, even if these machines perform, instead of an assembly proper, a braiding, a taping, a lapping, a stranding, or an operation similar thereto.

DESCRIPTION OF THE PRIOR ART

The document WO 93/07330 and the document FR-A 2,739,701 describe devices for performing a winding operation of at least one wire element comprising an optical means enabling the following measurements to be made during the winding operation:

- measurement, on the taut wire element drawn between the winding head and the place of winding itself, of the reflection intensity of an incident light beam;
- measurement, on the taut wire element drawn between the winding head and the place of winding itself, of the oscillation amplitude of the specular reflection angle of an incident light beam, this oscillation amplitude being representative of the tension of the wire element in the course of winding;
- implementation, on the taut wire element drawn between the winding head and the place of winding itself, of one of the measurements mentioned above only during a time window defined by a continuous means of the angular position of the winding head, in order to select a single specific wire element which is subjected to this measurement;
- measurement, on the taut wire element drawn between the winding head and the place of winding itself, of the presence/absence of the reflection intensity of an incident light beam for continuous measurement of the angular position of the winding head.

In this prior art, use is made of an optical assembly designed to send a light beam onto the wire element, and to make the corresponding optical measurements on the reflected light, and of an electronic means which receives signals coming from the optical assembly and auxiliary signals coming from other measuring elements to deliver the required data on operation of the machine, or to automatically make adjustments to the operating parameters of the machine.

A problem arising for this type of assembly machine of the prior art in case of automation of operation requires the following operations:

selecting and adapting a specific type of optical measuring device on the machine the characteristics of which device are compatible with the type of wire element used, selecting and adapting a specific type of power communication component on the machine the characteristics of which component are compatible with the type of functional apparatus which it is designed to control automatically, and selecting and adapting a specific device on the machine enabling the power communication component to be made operational, during operation of the machine, while deactivating the initial manual control of the functional apparatus of the assembly machine which this component has to control automatically, and to deactivate this component while making the initial manual control operational when the user wants to perform a manual control of this functional apparatus instead of automatic control thereof.

The processing conditions can vary considerably for the following reasons:

the existing assembly machines globally represent a relatively large pool of machines, but which includes a large diversity of types of machine (for example vertical or horizontal axis machines, machines for winding a single strand or for winding a large number of strands, automatic or manual control machines);

for a machine of a particular type, winding operations of different types can be performed (for example stranding, lapping, taping or braiding);

for a particular winding operation, wire elements of very different natures can be processed (for example certain wires are highly reflecting and others have a very low reflection, certain wires are thick and others are very thin, for example a few micrometers).

The ambient lighting conditions of the machine can vary in considerable proportions during the day (for example when the machine switches from normal artificial lighting at night-time to direct sunlight during the day through a window), and can vary in large proportions in instantaneous manner (for example when the artificial lighting of the workshop is on or off).

These observations result in a need to achieve a monitoring and control device with real time data sampling functions able to be fitted on an assembly machine with any operating cycle.

OBJECT OF THE INVENTION

An object of the present invention is to achieve a real time monitoring and control device for a universal assembly machine, usable with several types of operation and different winding modes.

The monitoring and control device according to the invention is characterized in that:

the microprocessor of the processing circuit receives and samples data coming from the optical measuring apparatus to know the position of the wire element and its behaviour in mechanical vibration in real time before the wire element is wound onto the main cable, storage means, notably an EPROM memory, are programmed to generate a self-correction function should a drift of the position and vibration data of the wire element occur, and electrical control means of the first motor, of the second motor, and of the mechanical tensioning means are arranged to re-establish optimum operation of the assembly machine.

According to a preferred embodiment, the electrical control means are controlled in real time by the microprocessor to adjust the synchronism between the first motor of the winding head and the second motor of the receiver coil pulling the main cable, and to establish a preset mechanical tension on the wire element by means of at least one electromagnetic brake. The processing circuit stores the values of the maximum, minimum and mean vibrations of the wire element after sampling to observe in real time the vibratory behaviour and positioning of said wire element on the screen page of the microcomputer, the resident program of the EPROM memory enabling the assembly machine to be loop-locked on the position and vibration of the wire element with respect to the main cable.

According to one feature of the invention, auxiliary ambient temperature and/or hygrometry sensors are connected to the processing circuit to be informed should a drift of the wire element occur linked to a fluctuating environment.

According to another feature of the invention, the emitter and receiver of the optical measuring apparatus are provided with incline adjustment means to adjust the field of emission and receipt of the light beam cooperating with the wire element.

BRIEF DESCRIPTION OF THE DRAWINGS

Other advantages and features of the invention will become more clearly apparent from the following description of an embodiment of the invention given as a non-restrictive example only and represented in the accompanying drawings in which.

DESCRIPTION OF A PREFERRED EMBODIMENT

Figure 1:
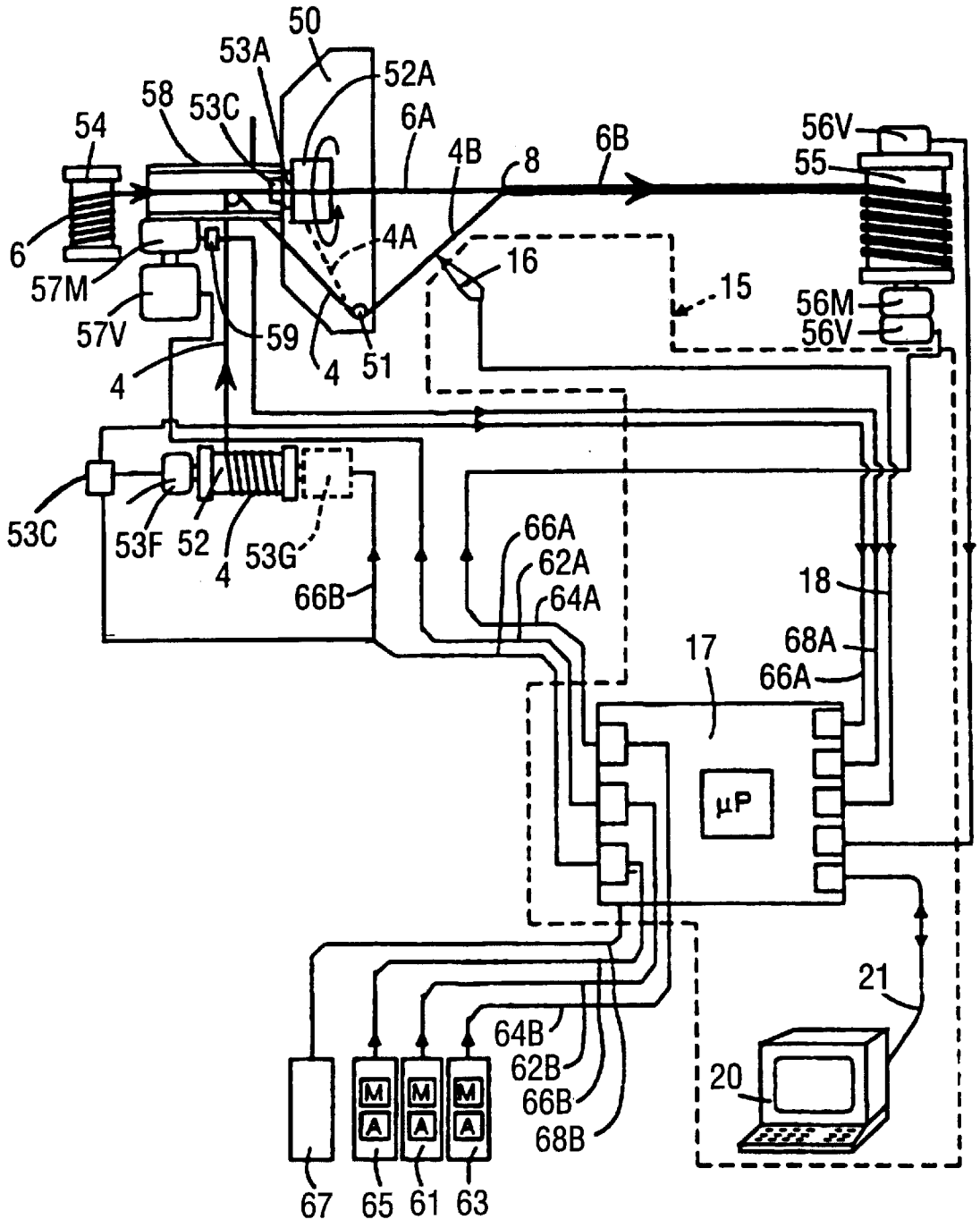
FIG. 1 is a schematic plane view of an assembly machine equipped with a monitoring and control device with real time data sampling according to the invention.

In FIG. 1, the assembly machine 15 comprises a winding head 50 equipped with an eccentric pulley 51 which guides a wire element 4 or 4A wound on a first feeder coil 52 or a second feeder coil 52A both slowed down by an electromagnetic brake respectively 53F and 53A. A third feeder coil 54 supports a wound main cable 6, a free end strand 6A of which extends from the coil 54 to a receiver coil 55, which is driven by a motor 56M and passes taut through the winding head 40 in coaxial manner. A free end strand 4B of the wire element 4 or 4A extends from the pulley 51 to a zone 8 of the cable strand 6A, this zone being situated between the winding head 50 and the receiver coil 55. A head motor 57M drives the winding head 50 in rotation via a suitable transmission 58. Such a machine is described in detail in the document FR-A2,739,701.

A speed and angular position encoder 59 measures the speed and angular position of the winding head 50. In operation, the wire element or elements 4 or 4A are wound onto the central cable 6 to form a wound, assembled, twisted cable 6B which is then wound on the receiver coil 55. The monitoring and control device with real time data sampling 15 (surrounded by dashed lines) comprises:

an optical measuring apparatus 16 arranged facing the end strand 4B and designed to deliver optical measurement signals, a data processing circuit 17 which receives measurement signals from the optical measuring apparatus 16 via a cable 18, and an external control means 20, for example a microcomputer, which enables a user to control at least one automatic operation parameter of the assembly machine by controlling a programmed operation of the data processing circuit 17 via a cable 21.

An output of the circuit 17 is connected to the variator 56V of the motor 56M via a branch cable 64A, and an input of the circuit 17 is connected to a corresponding control 63 via a branch cable 64B.

Another output of the circuit 17 is connected to the power supply 53C of the brake 53F via a branch cable 66A, and an input is connected to the control 65 via a cable 66B to control the motor 53G of the first feeder coil 52 in torque.

Another output of the circuit 17 is connected to the variator 57V of the motor 57M via a branch cable 62A, and an input is connected to the corresponding control 61 via a branch cable 62B.

An input of the circuit 17 is connected to the encoder 59 via a branch cable 68A, and an output is connected to the corresponding display means 67 via a branch cable 68B.

The computer 20 then acts as general control:

to control the motors 56M and 57M via the variators 56V and 57V, to control the brakes 53A, 53F, or the motor 53G which works in torque, to check the speed and angular position of the winding head 50 via the encoder 59, to display the value of the optical measuring apparatus 16, and/or for any other data, computation or display processing.

Figure 2:
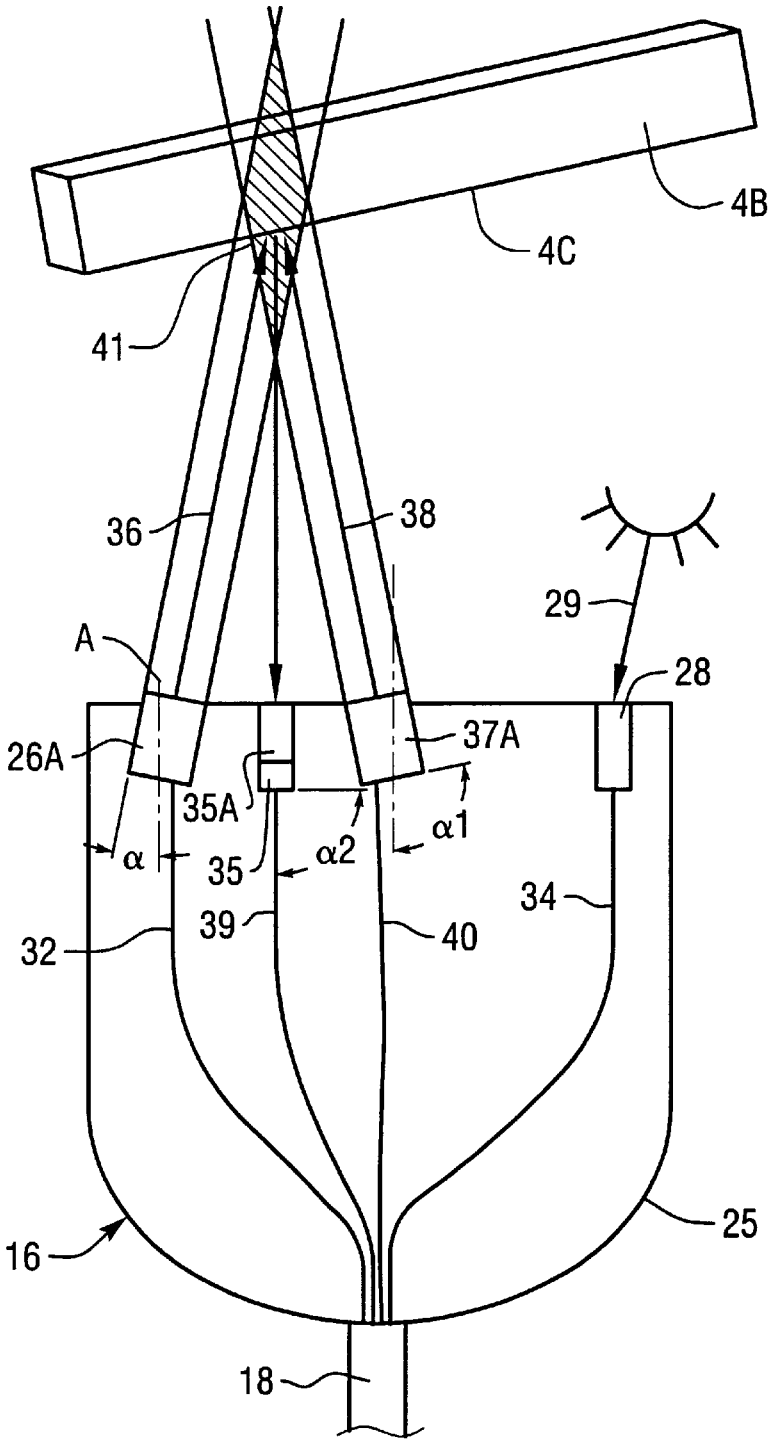
FIG. 2 is a cross sectional view of an optical measurement sensor constituting one of the elements of the device of FIG. 1.

In FIG. 2, the optical measuring apparatus 16 comprises an optical housing 25 containing a projection means for projecting a light beam by infrared 26A and 37A, an ambient light sensor 28, and a light receiver 35.

The projection means comprise a first infrared emitter 26A and a second infrared emitter 37A which project two light beams 36 and 38 having a precise angular origin of departure $\alpha$ and $\alpha 1$, creating an intersection 41 at a certain distance.

The infrared light receiver 35 is arranged inside the tube 35A and measures the light reflected by the wire element 4B. The receiver 35 enables a reflected light to be measured in non-specular manner, and it can therefore act:

as detector of presence/absence of the wire, as continuous analog measurement of a reflection characteristic of the wire (for example of the variation of the brightness of the wire, or of the variation of the colour of the wire) in order to perform a continuous check of the quality of the wire, as high sensitivity sensors with very fast response in the case where the wire is extremely fine or very dark, in order to detect in a precise manner in time the appearance of the wire element 4B in the field of the infrared beams 36 and 38.

The wires 32, 40 connected inside the housing 25 to the emitters 26A, 37A, the wire 39 connected to the receiver 35, and the wire 34 connected to the sensor 28, are all housed together in the sheath of the cable 18.

The emitters 26A, 37A of light 10 of the optical measuring apparatus 16 can have different emission wavelengths, and different emission powers. The angle $\alpha$, $\alpha 1$ of incline of the emitters 26A, 37A can be adjusted in order to increase or decrease the distance from the intersection zone 41. The angle of incline $\alpha 2$ of the light receiver 35 is also adjustable to modify the receipt zone.

The choice of the type of emitters 26A, 37A and of the light receiver 35 depends on the reflectivity characteristics of the wire element 4, and on the type of measurement to be made.

Figure 3:
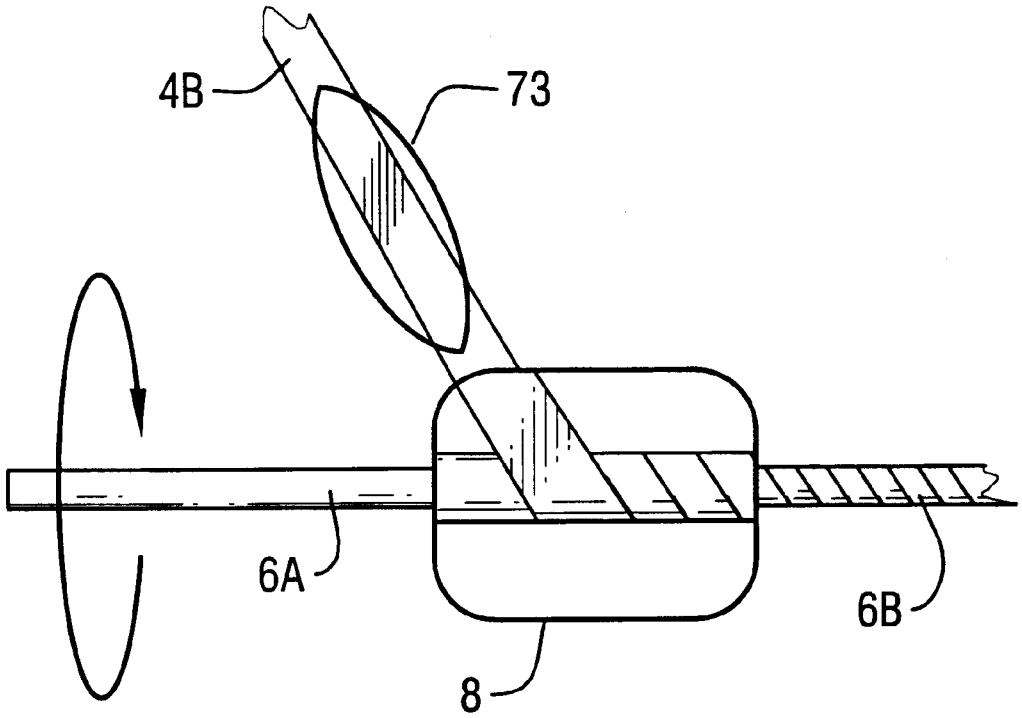
FIG. 3 shows the supervision zone of the winding process on an enlarged scale.

FIG. 3 shows the real time monitoring zone of the taping process on an enlarged scale. The optical measuring apparatus 16 enables the degree of vibration 73 of the taped strip of the wire element 4B to be checked before winding thereof is performed on the strand 6A of the main cable 6. Analysis of the vibration by the data processing circuit 17 enables the mechanical tension exerted on the strip by the brake 53F to be regulated. The winding point is also monitored by the optical measuring apparatus 16 in the zone 8 so as to obtain an optimum precision of placing as far as the overlap and pitch of the turns of the strip are concerned, and to detect any folding or turning of the strip.

Figure 4:
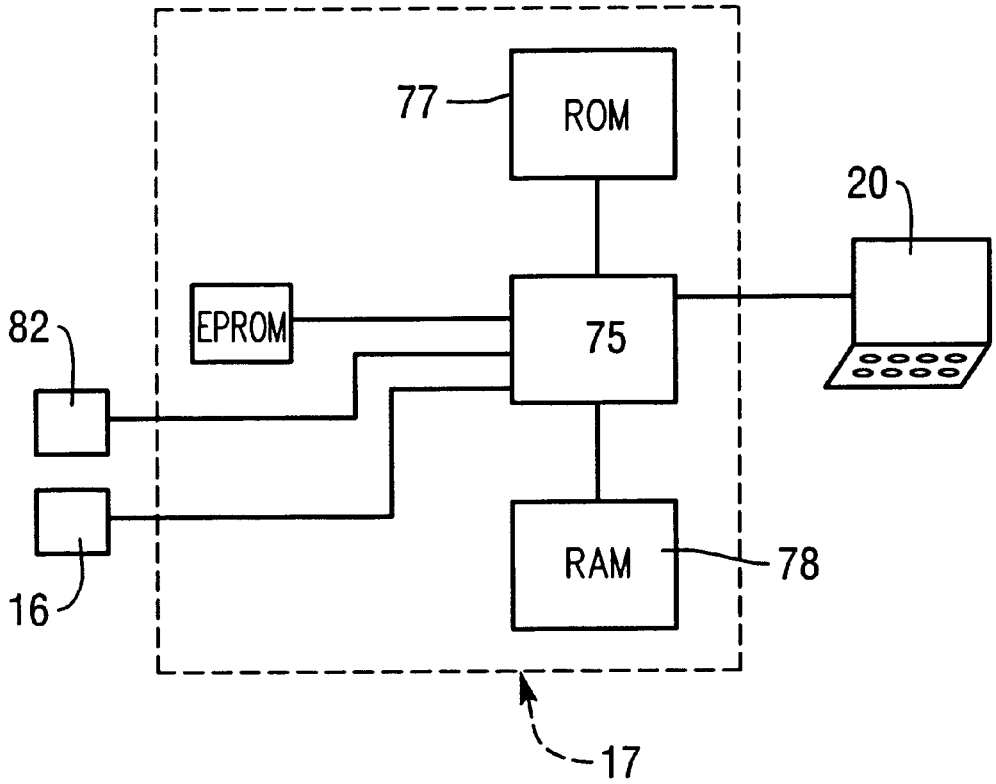
FIG. 4 represents a block diagram of the electronic processing circuit of the monitoring and control device.

In FIG. 4, the electronic processing circuit 17 comprises a microprocessor 75 designed to receive data in real time from the sensor 16, and operating in conjunction with the microcomputer of the external control means 20 for input of the data and parameters according to the required operating conditions. The microprocessor 75 is also connected to a ROM memory 77, a RAM memory 78, and an EPROM memory 80, which has a resident program which generates a self-correction function of an observed drift (position and vibration of the wire element) by acting on active components (brakes 53A of the wire element 4A, synchronism of the motors 56M, 57M, etc.).

Data sampling in real time by the sensor 16 enables the position of the wire element 4 and its behaviour relative to its maximum vibration to be known.

Figure 5:
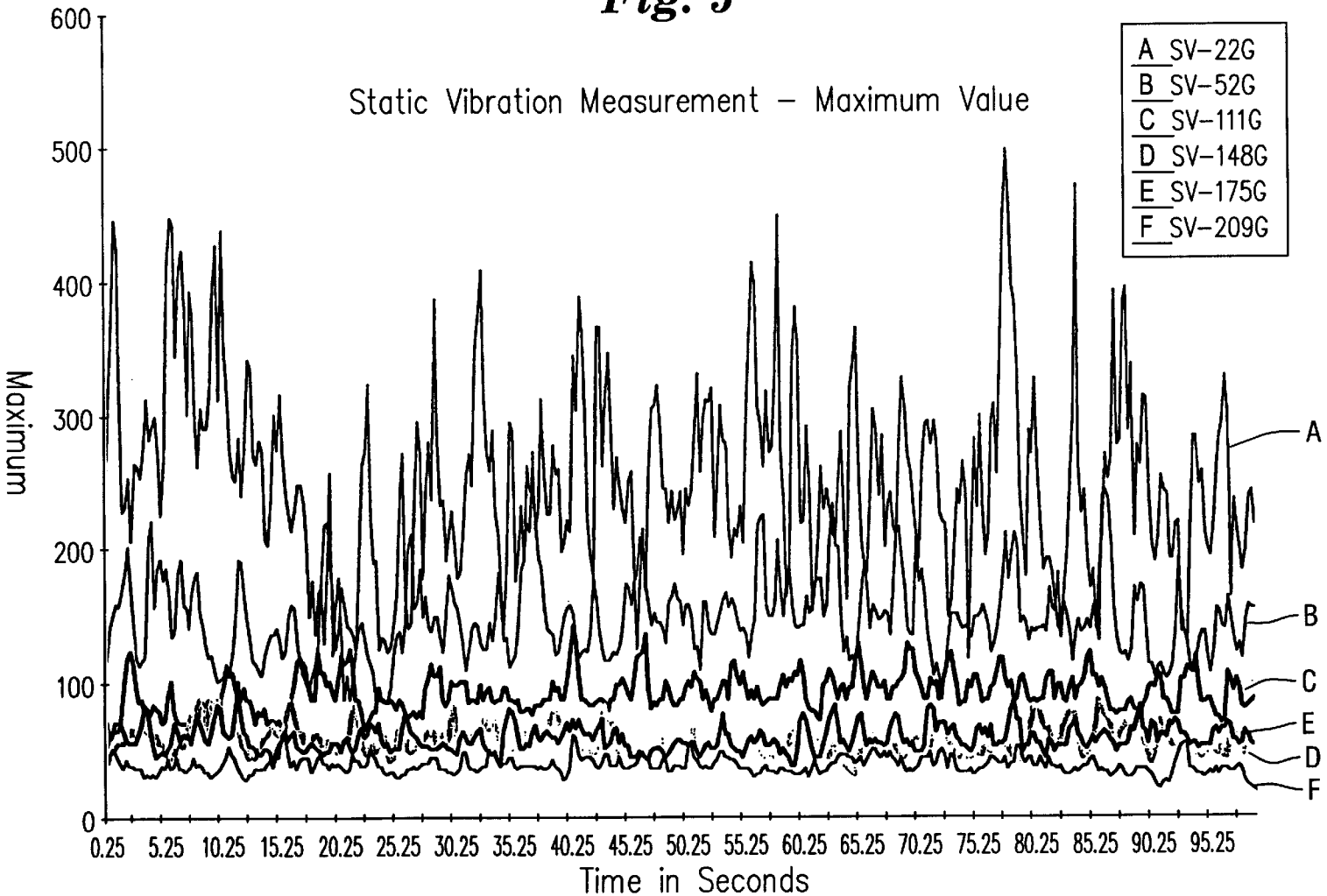
FIGS. 5 and 6 respectively illustrate the measuring diagrams of maximum and minimum vibrations of the wire elements for different mechanical tension values.
Figure 6:
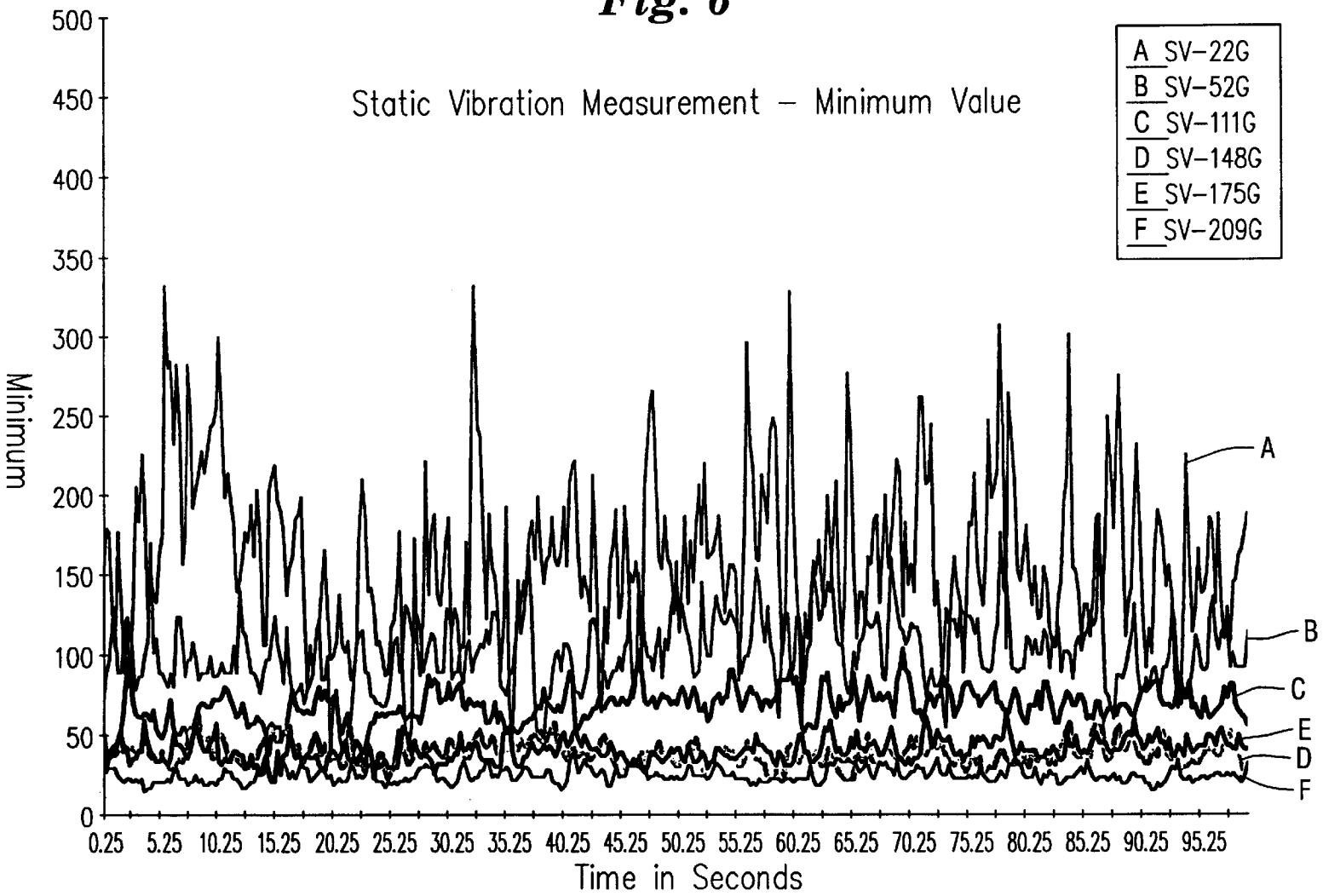

In the diagrams of FIGS. 5 and 6, the behaviour of the wire element 4 is displayed according to the value of the mechanical tension determined by the brake 53F.

The denomination SV-22G of diagram A corresponds to a tension of 22 grammes applied to the wire element 4. FIG. 5 shows the maximum vibration value, whereas FIG. 6 illustrates the minimum value, after sampling performed by the processing circuit 17.

The other diagrams B, C, D, E and F correspond to higher mechanical tensions, notably 52 grammes for the denomination SV-52G, 111 grammes for the denomination SV-111G, 148 grammes for the denomination SV-148G, 157 grammes for the denomination SV-157G, and 209 grammes for the denomination SV-209G.

Figure 7:
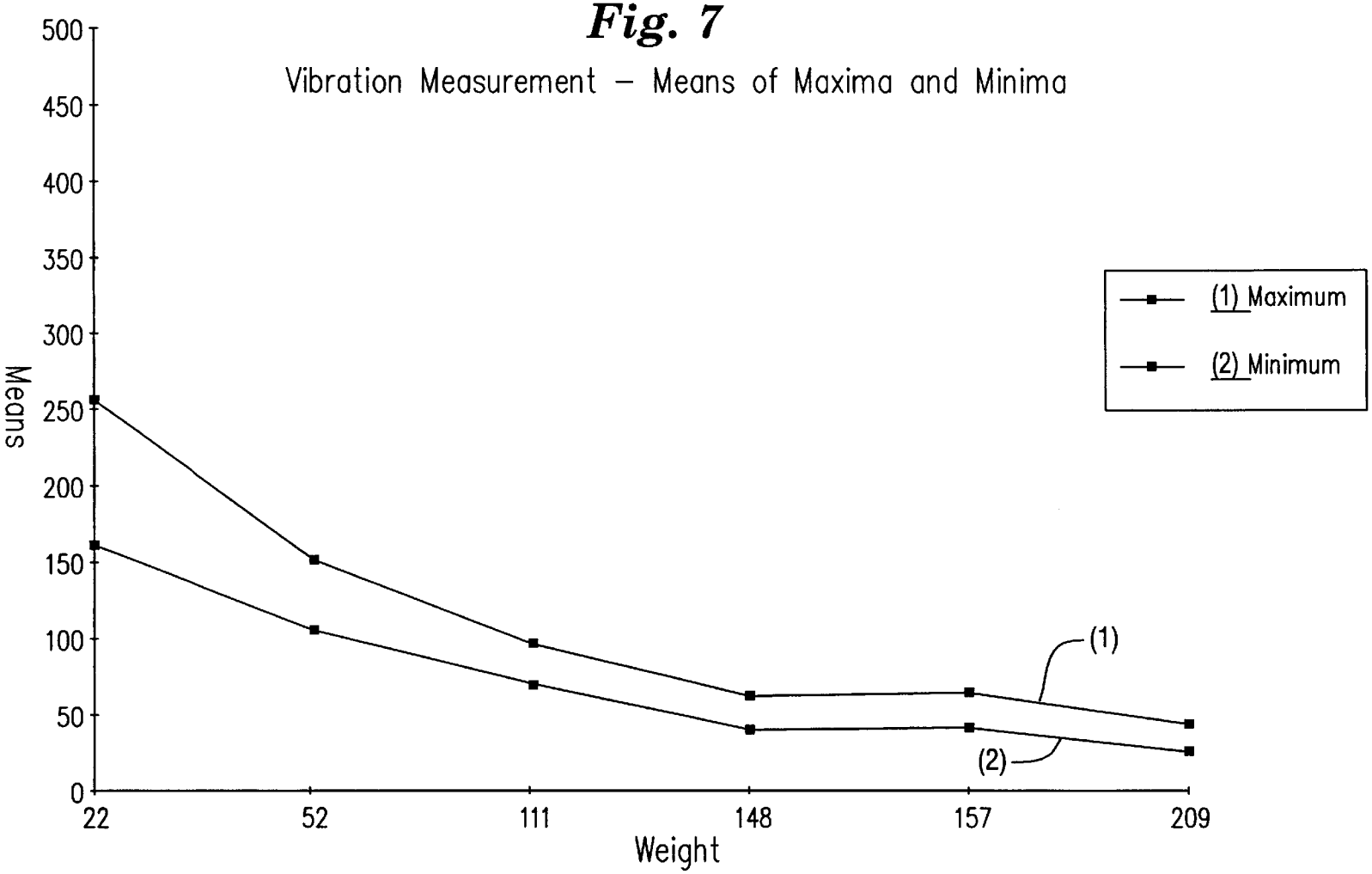
FIG. 7 shows two curves 1 and 2 representative of the mean values of maximum and minimum vibrations according to the mechanical tension applied to the wire element.

In FIG. 7, the mean value of the vibration observed on the wire element 4 subjected to a tension of 22 grammes (SV-22G) is 260 points. The difference between the maximum and minimum decreases after the tension has been increased to become almost constant between 148 grammes and 209 grammes.

This real time observation of the behaviour of the wire element 4 enables the operation of the assembly machine to be corrected very quickly. The position of the wire element 4 with respect to the strand of the main cable 6 is also known at all times.

Operation of the assembly machine can take place according to two distinct modes:

1/Manual Mode

It enables the assembly machine to be adjusted to deposit the wire element 4 at a precise place on the support of the main cable 6. The adjustments are made on:

- the synchronism between the winding head 50 of the wire element 4 and the rotation of the receiver coil 55 which pulls the main cable 6,
- the tension applied on the wire element 4 by means of the electromagnetic brake 53A.

After this manual adjustment of the monitoring and control device 15 on the assembly machine, the behaviour of the wire element can be observed on the screen page of the microcomputer 20, i.e.:

- the vibration of the wire element (Mean FIG. 7, Maximum FIG. 5, Minimum FIG. 6),
- the position of the wire element (Mean of the vibration, FIG. 7).

The user can perform adjustments to the above-mentioned settings and to the assembly machine settings at any time.

For example, in case of use of fragile materials (PTFE for example), the ambient temperature or the ambient hygrometry directly influences the behaviour of the wire element 4. The path taken by the wire element (guide roller, guide, etc.) can suddenly or progressively give rise to a difficulty (guide roller jammed, fouled guide, etc.) consequently increasing the tension of the wire element 4 and disturbing the positioning of the wire element 4 with respect to the previously adjusted main cable 6. Other parameters can influence deposition of the wire element 4, in particular in the case of a dimensional defect (width or diameter).

2/Mode of use in Automatic Mode

When switching takes place from manual mode to automatic mode, the vibration values of the wire element 4 are stored after sampling, as is the mean value of positioning of the wire element 4. These values therefore act as reference values for operation of the machine in automatic mode.

The resident program of the EPROM memory 80 provides for the assembly machine to be loop-locked on the position and vibration of the wire element 4 with respect to the main cable 6A. The resident program enables active components of the device 15 to be controlled to compensate for the drift observed (position of the wire element, vibration of the wire element) by priority orders programmed beforehand in the EPROM memory 80.

Should a drift of the position of the wire element 4 occur with respect to its initial stored position, the program enables adjustment to be made of the rotation setpoint of the winding head 50, speeding up or slowing down the winding head 50, or adjustment to be made of the pulling setpoint of the receiver coil 55 speeding up or slowing down the pull on the cable 6B, or by adjusting the mechanical tension setpoint applied to the wire element which also influences its position.

The order of priority of intervention on the active components can be modified by the assembly machine user at any time to contribute to optimum positioning of the wire element 4 with respect to the main cable 6, and/or to minimize or increase the vibration of the wire element 4.

If the drifts observed are too great for self-correction, the resident program of the EPROM memory 80 is designed to stop the assembly machine.

Real time supervision of deposition of the wire element 4 and of vibration thereof is associated to a traceability which enables the user to be informed of the drifts observed, in order to know the resulting quality level on a given manufacture and to know the manufacturing process concerning such or such a product by associating thereto the manufacturing times, manufacturing speeds (winding head rotation, etc.) and any stoppages which may have occurred (change of wire element for example). This supervision of the wire element also enables the drift which may occur consecutive to parameters external to the assembly machine (ambient temperature, hygrometry, etc.) to be known. Auxiliary sensors 82 transmit the temperature and hygrometry measurements to the microprocessor 75 for this purpose.

What is claimed is:

1. A monitoring and control device for an assembly machine designed to perform a winding operation of at least one wire element onto a main cable to form a wound cable, said assembly machine being equipped with actuators comprising:

- a winding head which guides said wire element wound on at least one feeder coil,
- a first head motor for driving the winding head in rotation,
- a second motor for driving in rotation a receiver coil on which said wound cable is wound,
- and means for mechanical tensioning of the wire element when the winding phase takes place, said monitoring and control device comprising:

- an optical measuring apparatus containing at least one light emitter for projection of a light beam onto the wire element, and a receiver for sensing the reflected light beam with production of a measurement signal,
- a processing circuit with microprocessor designed to receive said measurement signal and to send control and/or adjustment signals to said actuators,
- and an external control means comprising in particular a microcomputer for input of automatic operation parameters of the assembly machine according to a predetermined program of the processing circuit, characterized in that:

- the microprocessor of the processing circuit receives and samples data coming from the optical measuring apparatus to know the position of the wire element and its behavior in mechanical vibration in real time before the wire element is wound onto the main cable,
- storage means, are programmed to store data concerning the values of maximum, minimum and mean vibrations of the wire element to observe the vibratory behavior and positioning of said wire element in real time on the screen page of the microcomputer, so as to generate a self-correction function should a drift of the position and vibration data of the wire element occur,
- and electrical control means of the first motor, of the second motor, and of the mechanical tensioning means are arranged to re-establish optimum operation of the assembly machine, the resident program of the storage means enabling the assembly machine to be loop-locked to the position and vibration of the wire element with respect to the main cable.

2. The monitoring and control device according to claim 1, characterized in that the electrical control means are controlled in real time by the microprocessor to adjust the synchronism between the first motor of the winding head and the second motor of the receiver coil pulling the main cable, and to establish a preset mechanical tension on the wire element by means of at least one electromagnetic brake.

3. The monitoring and control device according to claim 1, characterized in that auxiliary ambient temperature and/or hygrometry sensors are connected to the processing circuit to be informed should a drift of the wire element occur linked to a fluctuating environment.

4. The monitoring and control device according to claim 1, characterized in that the emitter and receiver of the optical measuring apparatus are provided with incline adjustment means to adjust the field of emission and receipt of the light beam cooperating with the wire element.

5. The monitoring and control device according to claim 1, characterized in that the first motor is equipped with a speed and angular position encoder connected to the processing circuit to check the speed and angular position data of the winding head, said data being displayed on a display means.

6. The monitoring and control device according to claim 4, characterized in that the optical measuring apparatus is equipped with an ambient light sensor and with two infrared light emitters surrounding the central receiver, the assembly being arranged inside a housing arranged close to the wire element.

* * * * *